US007663565B2

(12) United States Patent
Son et al.

(10) Patent No.: US 7,663,565 B2
(45) Date of Patent: Feb. 16, 2010

(54) PEDESTAL APPARATUS AND SATELLITE TRACKING ANTENNA HAVING THE SAME

(75) Inventors: Seong-Ho Son, Daejon (KR); Jae-Seung Yun, Daejon (KR); Young-Bae Jung, Daejon (KR); Soon-Young Eom, Daejon (KR); Soon-Ik Jeon, Daejon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 0 days.

(21) Appl. No.: 12/090,713

(22) PCT Filed: Sep. 25, 2006

(86) PCT No.: PCT/KR2006/003801

§ 371 (c)(1),
(2), (4) Date: Apr. 18, 2008

(87) PCT Pub. No.: WO2007/046589

PCT Pub. Date: Apr. 26, 2007

(65) Prior Publication Data

US 2008/0258988 A1 Oct. 23, 2008

(30) Foreign Application Priority Data

Oct. 20, 2005 (KR) ..... 10-2005-0099127

(51) Int. Cl.
*H01Q 3/02* (2006.01)

(52) U.S. Cl. ..... 343/765; 343/766; 248/183.1; 248/278.1

(58) Field of Classification Search ..... 343/757, 343/765, 766, 878, 882; 248/278.1, 179.1, 248/183.1

See application file for complete search history.

(56) References Cited

U.S. PATENT DOCUMENTS

| | | | | |
|---|---|---|---|---|
| 3,163,935 | A * | 1/1965 | Webb | 33/1 R |
| 3,893,123 | A * | 7/1975 | Bieser | 343/706 |
| 3,999,184 | A | 12/1976 | Fuss, III | |
| 5,359,337 | A | 10/1994 | Eguchi | |
| 5,419,521 | A | 5/1995 | Matthews | |

(Continued)

FOREIGN PATENT DOCUMENTS

| | | |
|---|---|---|
| JP | 55-001781 | 1/1980 |

(Continued)

*Primary Examiner*—Tho G Phan
(74) *Attorney, Agent, or Firm*—Rabin & Berdo, P.C.

(57) ABSTRACT

Provided are a pedestal apparatus and a satellite-tracking antenna having the same. The pedestal apparatus includes: a fixing unit fixed at a moving object; a connecter for forming a first rotating axis vertically to the fixing unit; a first rotation supporter having a bottom fixed at the fixing unit and a Y-shaped top for rotating the tracking antenna around the first rotating axis; a second connecter connected to ends of the Y-shaped top for forming a second rotating axis; a second rotation supporter having both ends connected to the both ends of the second connecter for rotating the tracking antenna around the second rotating axis; a third connecter for forming a third rotating axis at a center of the second rotation supporter; and a supporter connected to the third connecter in a predetermined shape for supporting the tracking antenna, wherein the first, second and third rotating axes are not crossed one another.

7 Claims, 5 Drawing Sheets

U.S. PATENT DOCUMENTS

| | | | | |
|---|---|---|---|---|
| 5,453,753 | A * | 9/1995 | Cosenza et al. | 343/765 |
| 5,922,039 | A | 7/1999 | Welch et al. | |
| 6,577,281 | B2 | 6/2003 | Yamamoto et al. | |
| 6,914,578 | B1 | 7/2005 | Menahem | |

FOREIGN PATENT DOCUMENTS

| | | |
|---|---|---|
| KR | 2002-0054179 | 7/2002 |
| KR | 2004-0069685 | 8/2004 |

* cited by examiner

PEDESTAL APPARATUS AND SATELLITE TRACKING ANTENNA HAVING THE SAME

TECHNICAL FIELD

The present invention relates to a pedestal apparatus for stabilizing the attitude of a tracking antenna mounted at a moving object and a satellite antenna having the same; and, more particularly, to a pedestal apparatus having three axes for sustaining the attitude of the satellite antenna mounted at a moving object to face a target satellite although the moving object such as a ship is yawing, rolling or pitching.

BACKGROUND ART

An antenna is mounted at a moving object to receive and transmit a signal from and to a satellite. The antenna mounted at the moving object is controlled to track a target satellite while the moving object is moving. Since the antenna is vibrated by the motion of the moving object, the motion of the moving object is compensated to accurately control the antenna.

As conventional technology for compensating the motion of the moving object, a stabilized antenna system was introduced in U.S. Pat. No. 5,359,337. The conventional stabilized antenna system has an X1-Y-X2 mount structure having three axes, an X1 axis, a Y axis, and an X2 axis. The X1 axis is disposed in parallel to the moving direction of a moving object. The Y axis is disposed vertically to the X1 axis and moves with the X1 axis as a center when the X1 axis rotates. The X2 axis is disposed vertically to the Y axis and moves with the Y axis as a center when the Y axis rotates. Herein, the X2 axis is an electronic control axis that changes the directivity of neighbor antenna, compensates roll elements related to the rolling of the moving object by the rotation of X1 axis, and compensates pitch element related to the pitching of the moving object by the rotation of the Y axis and X2 axis.

As another conventional technology, a three-axis pedestal was introduced in U.S. Pat. No. 5,419,521. The conventional three-axis pedestal is suitable for mounting on a moving structure to provide a unit for obtaining rotational stabilization of an antenna about three mutually perpendicular axes. The pedestal includes a spindle unit, a cantilevered structural member, a pair of spaced apart co-axial bearings, a shaft, a structural beam and a structural unit. The centerline of the spindle unit defines a first pivot axis, and the spindle unit is rigidly attached to the moving structure. The cantilevered structural member includes one end mounted for pivoting motion about the first pivot axis of the spindle unit. The pair of spaced apart co-axial bearings is mounted on the other end of the cantilevered member so that the centerlines thereof define a second pivot axis perpendicular to and intersecting the first pivot axis. The bearings are located on the cantilevered member close to an upward extension of the first axis. The shaft is mounted in the pair of bearings for pivot motion about said second pivot axis. The structural beam is rigidly attached to the shaft. The beam carries a journal at each end thereof so that the centerlines of the journals define a third pivot axis. The third axis is perpendicular to the second pivot axis and nominally intersected the intersection point of the first and second pivot axes. The structural unit is mounted for pivot motion about said third pivot axis. The structural unit is rigidly attached to and supports the object for orbital motion about the common intersection point of each of the first, second and third axes.

However, the conventional pedestal apparatuses are not suitable for a moving object having a wide moving range.

Also, it is not easy to control for stabilizing the attitude of a satellite tracking antenna, and it requests a high manufacturing cost.

DISCLOSURE

Technical Problem

It is, therefore, an object of the present invention to provide a pedestal apparatus, which is suitable for a moving object having a wide moving range, easily controlled for stabilizing the attitude of a satellite tracking antenna, requires a less manufacturing cost, has a durable structure and the structure of easy maintenance, and a satellite antenna having the same.

Technical Solution

In accordance with one aspect of the present invention, there is provided a pedestal apparatus for stabilizing an attitude of a tracking antenna mounted at a moving object, the pedestal apparatus including: a fixing unit rigidly fixed at the moving object; a connecting unit disposed inside the fixing unit for forming a first rotating axis vertically to a surface of the fixing unit that is fixed at the moving object; a first rotation supporting unit having a bottom supporting member fixed at the fixing unit and a Y-shaped top supporting member bifurcated to two tines for rotating the tracking antenna around the first rotating axis; a second connecting unit connected to ends of two tines of the Y-shaped top supporting member for forming a second rotating axis; a second rotation supporting unit having both ends connected to the both ends of the second connecting unit for rotating the tracking antenna around the second rotating axis; a third connecting unit for forming a third rotating axis at a center of the second rotation supporting unit; and a supporting unit connected to the third connecting unit in a predetermined shape for supporting the tracking antenna, wherein the first, second and third rotating axes are not crossed one another.

In accordance with another aspect of the present invention, there is provided a satellite antenna mounted at a moving object, the antenna including: a radome for protecting the satellite antenna having a pedestal apparatus from an external environment; a vibration attenuating unit disposed at an outer bottom surface of the radome for absorbing vibration made by the moving object; and a pole connected to the moving object by being connected to the vibration attenuating unit, wherein the pedestal apparatus includes: a fixing unit rigidly fixed at the moving object; a connecting unit disposed inside the fixing unit for forming a first rotating axis vertically to a surface of the fixing unit that is fixed at the moving object; a first rotation supporting unit having a bottom supporting member fixed at the fixing unit and a Y-shaped top supporting member bifurcated to two tines for rotating the tracking antenna around the first rotating axis; a second connecting unit connected to ends of two tines of the Y-shaped top supporting member for forming a second rotating axis; a second rotation supporting unit having both ends connected to the both ends of the second connecting unit for rotating the tracking antenna around the second rotating axis; a third connecting unit for forming a third rotating axis at a center of the second rotation supporting unit; and a supporting unit connected to the third connecting unit in a predetermined shape for supporting the tracking antenna, wherein the first, second and third rotating axes are not crossed one another.

ADVANTAGEOUS EFFECTS

A pedestal apparatus and a satellite tracking antenna having the same in accordance with the present invention have following advantages.

The three-axis pedestal apparatus according to the present invention can stabilize the tracking antenna mounted at a moving object although the moving object is yawing, rolling and pitching.

By disposing a vibration attenuating unit between a radome and a pole connected to the moving object, the size of the radome is minimized, a manufacturing cost thereof is reduced and easy maintenance is allowed.

Furthermore, by disposing a driving unit at a sensor cage for an additional rotating axis, the sensor cage is enabled to constantly maintain a horizontal level although the target direction of the satellite tracking antenna is changed.

DESCRIPTION OF DRAWINGS

The above and other objects and features of the present invention will become apparent from the following description of the preferred embodiments given in conjunction with the accompanying drawings, in which.

BEST MODE FOR THE INVENTION

Other objects and aspects of the invention will become apparent from the following description of the embodiments with reference to the accompanying drawings, which is set forth hereinafter.

Figure 1:
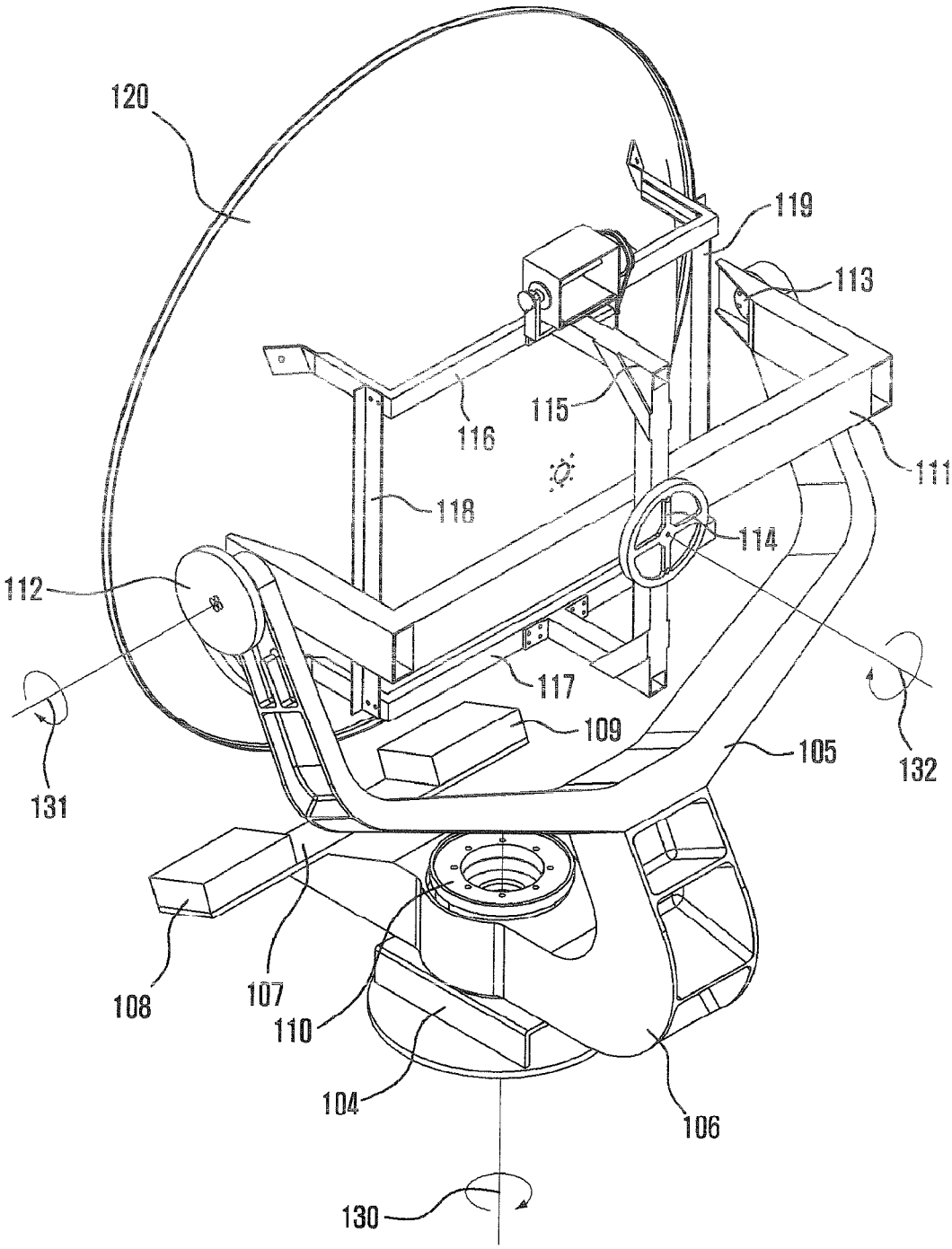
FIG. 1 is a perspective view of a tracking antenna having a pedestal apparatus in accordance with an embodiment of the present invention.
Figure 2:
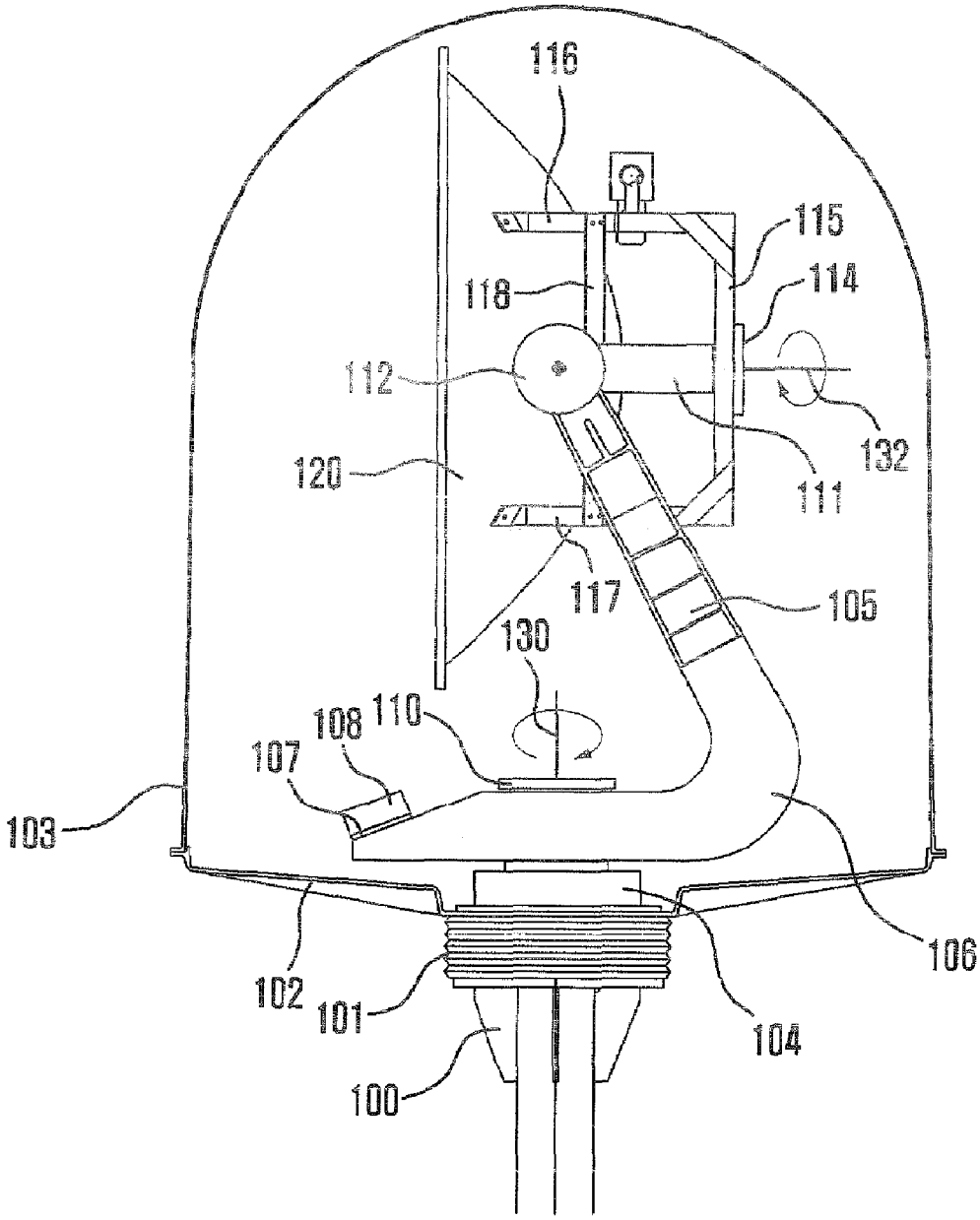
FIG. 2 is a side view of the tracking antenna of FIG. 1.
Figure 3:
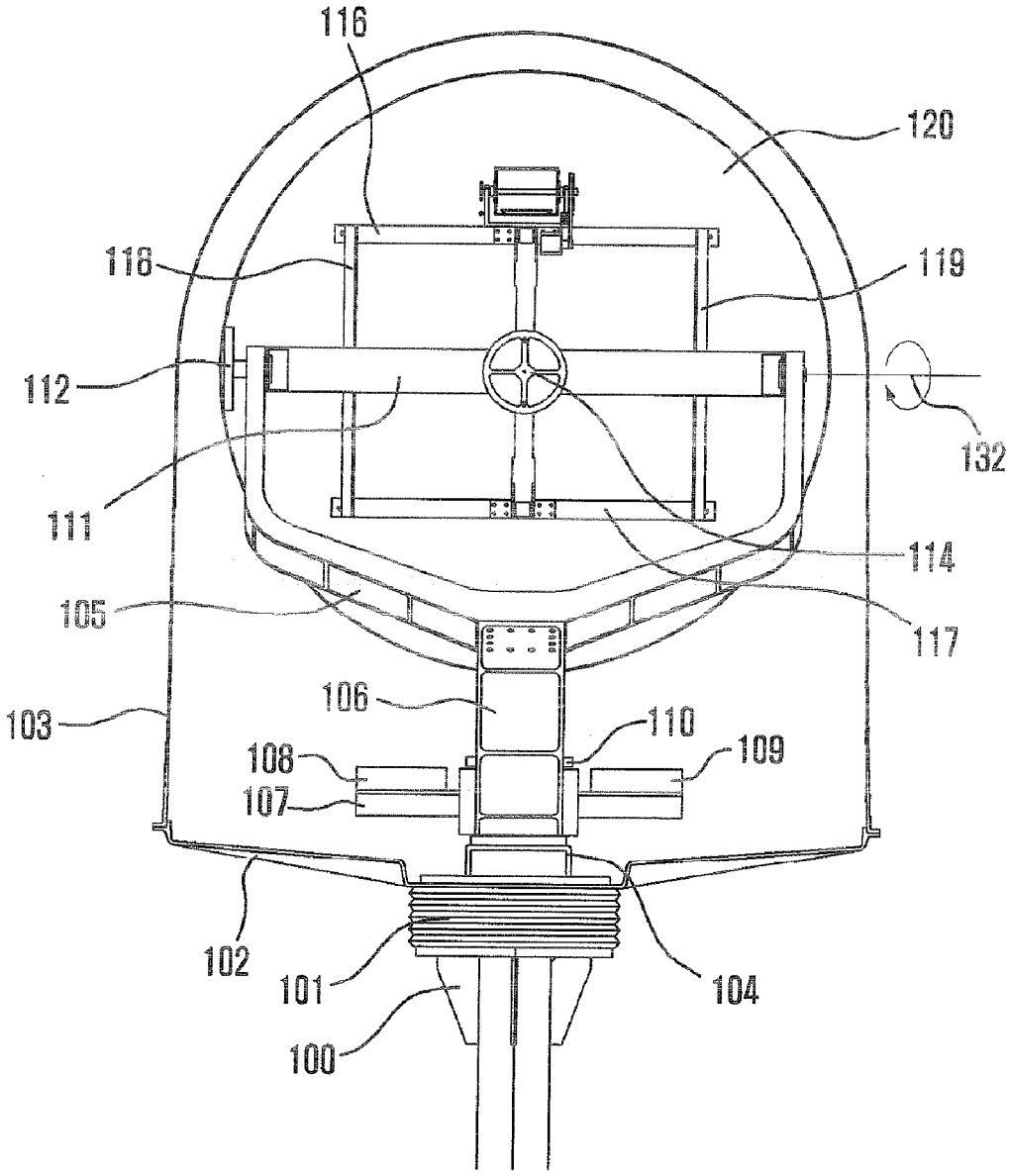
FIG. 3 is a rear view of the tracking antenna shown in FIG. 1.
Figure 4:
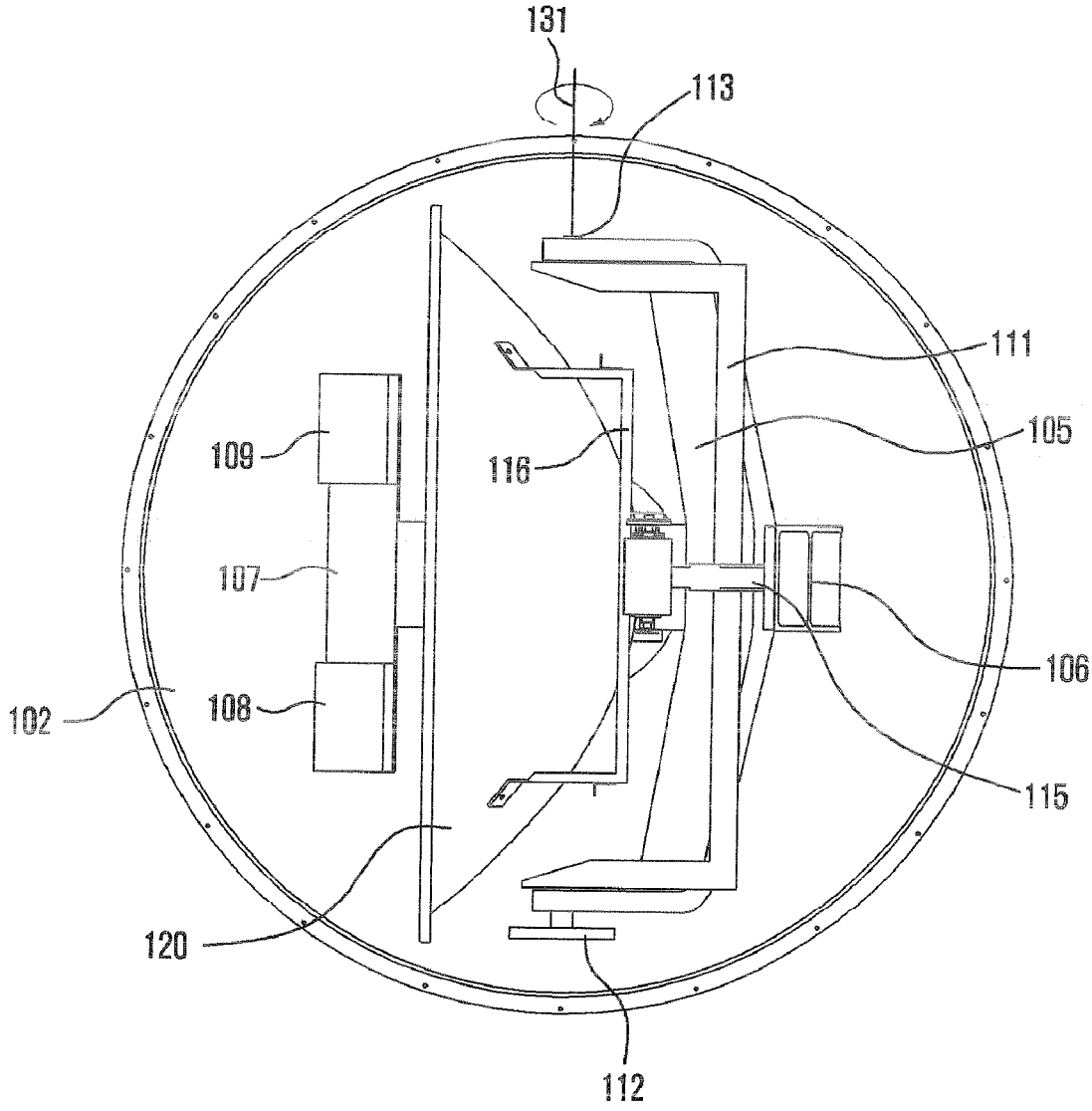
FIG. 4 is a front view of the tracking antenna shown in FIG. 1.
Figure 5:
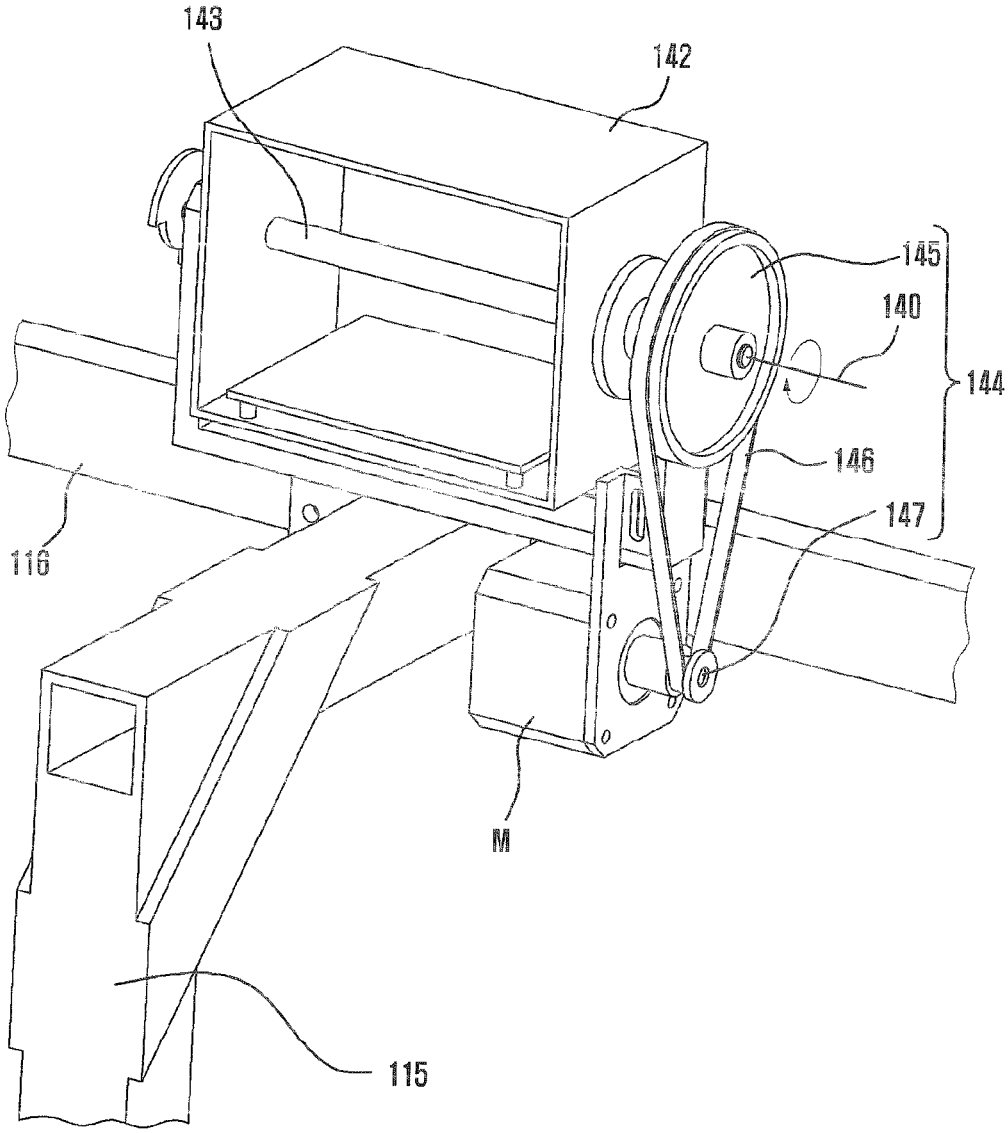
FIG. 5 is a perspective view illustrating a sensor cage mounted at the tracking antenna of FIG. 1.

FIGS. 1 to 5 are views illustrating a satellite antenna having a pedestal apparatus in accordance with an embodiment of the present invention. FIG. 1 is a perspective view of a tracking antenna having a pedestal apparatus in accordance with an embodiment of the present invention. FIG. 2 is a side view of the tracking antenna of FIG. 1, and FIG. 3 is a rear view of the tracking antenna shown in FIG. 1. FIG. 4 is a front view of the tracking antenna shown in FIG. 1, and FIG. 5 is a perspective view illustrating a sensor cage mounted at the tracking antenna of FIG. 1.

As shown in FIG. 1, the pedestal apparatus according to the present embodiment includes a fixing unit 104, a first connecting unit 110, a first rotation supporting unit having a Y-shaped top supporting member 105 and a bottom supporting member 106, second connecting units 112 and 113, a second rotation supporting unit 111, a third connecting unit 114 and a supporting unit. The block shaped fixing unit 104 is rigidly fixed at the moving object. The first connecting unit 110 is disposed at the inside of the fixing unit 104 for forming a first rotating axis 130 vertically to the surface of the fixing unit 104, which is fixed at the moving object. The first rotation supporting unit has a bottom supporting member 106 fixed at the fixing unit 104 and a Y-shaped top supporting member 105 which is bifurcated to two tines for rotating a reflector antenna 120 around the first rotating axis 130. The second connecting units 112 and 113 are respectively disposed at ends of two tines of the first rotating supporting unit 105 and 106 to form a second rotating axis 131. The second rotation supporting unit 111 has a U-shape, and both ends of the U shaped second rotation supporting unit 111 are connected to the second connecting units 112 and 113, respectively. The second rotation supporting unit 111 supports the reflector antenna 120 to be rotated around the second rotation axis 131. The third connecting unit 114 is disposed at the center of the second rotation supporting unit 111 for forming a third rotating axis 132, and the supporting unit is connected to the third connecting unit 114 in a predetermined shape for supporting the reflector antenna 120. The first, second and third rotating axes 130, 131 and 132 are not crossed one another.

The first, second, and third rotating axes 130, 131 and 132 are not crossed one another when the extension line of the first rotating axis 130 is formed to be disposed at a center area of a rotating structure connected to the first rotating axis 130 in order not to cross with the extension lines of the second and the third rotating axes 131 and 132.

Meanwhile, the supporting unit includes a predetermined shaped first supporting member 115 connected to the third connecting unit 114, second supporting members 116 and 117 each of which is extended from the both ends of the first supporting member 115 for supporting the reflector antenna 120, and third supporting members 118 and 119 for holding the second supporting members 116 and 117 not to be separated.

Also, a supporting plate 107 is disposed at the bottom supporting member 106. Modules 108 and 109 such as an RF module or a power source module may be disposed at the supporting plate 107.

Furthermore, the centers of gravity of the rotating axes 130, 131 and 132 are present at corresponding rotating axes 130, 131 and 132, respectively, in the tracking antenna having the pedestal apparatus according to the present embodiment. That is, the centers of gravity for the antenna elements 105 to 120 which rotate around the first rotating axis 130 are present on the first rotating axis 130, the centers of gravity of the antenna elements 111 to 120 which rotate around the second rotating axis 131 are present on the second rotating axis 131, and the centers of gravity of the antenna elements 115 to 120 which rotate around the third rotating axis 132 are present on the third rotating axis 132.

Meanwhile, FIGS. 1 through 4 illustrate a tracking antenna having a pedestal apparatus mounted at a moving object in accordance with an embodiment of the present invention.

The tracking antenna having the pedestal apparatus includes a radome including a top cover 103 and a bottom cover 102 to protect the tracking antenna from an external environment. A vibration attenuating unit 101 is disposed at the outer surface of the bottom cover 102 of the radome to absorb the vibration made by the moving object. The vibration attenuating unit 101 may be connected to a pole 100 connected to the moving object.

FIG. 5 is a perspective view illustrating a sensor cage mounted at a tracking antenna having a pedestal apparatus in accordance with an embodiment of the present invention.

The pedestal apparatus according to the present embodiment further includes a sensor cage 142. The sensor cage includes a clinometer, an angle speedometer and an azimuth angle compass for measuring the motion of the tracking antenna made by yawing, rolling an pitching motion of the moving object in order to stabilize the attitude of the tracking antenna. The clinometer measures the angles of the rolling and pitching motion made by the tracking antenna. The angle speedometer measures the angle speed of yawing, rolling and pitching motion made by the tracking antenna. The azimuth angle compass measures an azimuth angle that the tracking antenna directs. The measurements from the clinometer, the angle speedometer and the azimuth angle compass are used to a control process for stabilizing the attitude of the tracking antenna.

Also, the sensor cage 142 is connected to a supporting unit supporting the tracking antenna and provides an additional elevation angle rotating axis 140 in parallel to the elevation angle rotating axis 131 of the pedestal apparatus. That is, the sensor cage 142 has a structure allowing itself to rotate around the additional elevation angle rotating axis 140. Furthermore, the sensor cage 142 includes a driving unit 144 for allowing the sensor cage 142 to rotate around the additional elevation angle rotating axis 140. The driving unit 144 includes a rod 143 for supporting the sensor cage 142 rotatably to the elevation angle rotating axis 140, a driven pulley 145 connected to the one end of the rod 143, a driving pulley 147 connected to a driving motor M and rotated by receiving power from the driving motor M, and a belt 146 for connecting the driving pulley 147 and the driven pulley 145 in order to transfer the rotating power of the driving pulley 147 to the driven pulley 145.

As shown in FIG. 5, a belt drive device is used as the driving unit 144. However, the driving unit 114 may be embodied as other electric power drive devices such as a chain drive device and a gear.

The present application contains subject matter related to Korean patent application No. 2005-0099127, filed in the Korean Intellectual Property Office on Oct. 20, 2005, the entire contents of which is incorporated herein by reference.

While the present invention has been described with respect to certain preferred embodiments, it will be apparent to those skilled in the art that various changes and modifications may be made without departing from the scope of the invention as defined in the following claims.

What is claimed is:

1. A pedestal apparatus for stabilizing an attitude of a tracking antenna mounted at a moving object, the pedestal apparatus comprising:

a fixing means rigidly fixed at the moving object;

a first connecting means disposed inside the fixing means for forming a first rotating axis vertically to a surface of the fixing means that is fixed at the moving object;

a first rotation supporting means having a bottom supporting member fixed at the fixing means and a Y-shaped top supporting member bifurcated to two tines for rotating the tracking antenna around the first rotating axis;

two second connecting means, each being connected to an end of a respective one of the two tines of the Y-shaped top supporting member for forming a second rotating axis;

a second rotation supporting means having both ends, each end being connected to a respective one of the two second connecting means for rotating the tracking antenna around the second rotating axis;

a third connecting means for forming a third rotating axis at a center of the second rotation supporting means; and a supporting means connected to the third connecting means in a predetermined shape for supporting the tracking antenna, wherein the first, second and third rotating axes are not crossed one another, wherein the center of gravity of a first combination of the first rotation supporting means, the two second connecting means, the second rotation supporting means, the third connecting means, the supporting means and the tracking antenna is present on the first rotating axis, wherein the center of gravity of a second combination of the second rotation supporting means, the third connecting means, the supporting means and the tracking antenna is present on the second rotating axis, and wherein the center of gravity of a third combination of the supporting means and the tracking antenna is present on the third rotating axis.

2. The pedestal apparatus as recited in claim 1, wherein the second rotating axis is disposed to penetrate at least a portion of the tracking antenna.

3. A pedestal apparatus for stabilizing an attitude of a tracking antenna mounted at a moving object, the pedestal apparatus comprising:

a fixing means rigidly fixed at the moving object;

a first connecting means disposed inside the fixing means for forming a first rotating axis vertically to a surface of the fixing means that is fixed at the moving object;

a first rotation supporting means having a bottom supporting member fixed at the fixing means and a Y-shaped top supporting member bifurcated to two tines for rotating the tracking antenna around the first rotating axis;

two second connecting means, each being connected to an end of a respective one of the two tines of the Y-shaped top supporting member for forming a second rotating axis;

a second rotation supporting means having both ends, each end being connected to a respective one of the two second connecting means for rotating the tracking antenna around the second rotating axis;

a third connecting means for forming a third rotating axis at a center of the second rotation supporting means; and a supporting means connected to the third connecting means in a predetermined shape for supporting the tracking antenna, wherein the first, second and third rotating axes are not crossed one another, wherein the pedestal apparatus further comprises a sensor cage for performing an attitude stabilization controlling process, and wherein the sensor cage includes:

a clinometer for measuring an angle of rolling and pitching of the tracking antenna made by the motion of the moving object;

an angle speedometer for measuring an angle speed of yawing, rolling and pitching of the tracking antenna made by the motion of the moving object; and an azimuth angle compass for measuring an azimuth angle of the tracking antenna.

4. The pedestal apparatus as recited in claim 3, wherein the sensor cage is disposed at a supporting means supporting the tracking antenna to provide an additional elevation angle rotating axis in parallel to the elevation angle rotating axis of the pedestal apparatus in order to allow the sensor cage to rotate around the additional elevation angle rotating axis.

5. The pedestal apparatus as recited in claim 3, wherein the sensor cage further includes a driving means for allowing the sensor cage to rotate around the additional elevation angle rotating axis.

6. The pedestal apparatus as recited in claim 5, wherein the driving means includes:

a rod for supporting the sensor cage rotatably around an elevation rotating axis;

a driven pulley connected to the end of the rod;

a driving pulley connected to a driving motor and rotated by receiving a driving power from the driving motor; and a belt connecting the driving pulley and the driven pulley for transferring the rotating power of the driving pulley to the driven pulley.

7. A satellite antenna device mounted at a moving object, comprising:

a tracking antenna;

a radome for protecting the tracking antenna from an external environment;

a pedestal apparatus for stabilizing an attitude of the tracking antenna;

a vibration attenuating means disposed at an outer bottom surface of the radome for absorbing vibration made by the moving object; and a pole connected to the moving object by being connected to the vibration attenuating means, wherein the pedestal apparatus includes:

a fixing means rigidly fixed at the moving object;

a first connecting means disposed inside the fixing means for forming a first rotating axis vertically to a surface of the fixing means that is fixed at the moving object;

a first rotation supporting means having a bottom supporting member fixed at the fixing means and a Y-shaped top supporting member bifurcated to two tines for rotating the tracking antenna around the first rotating axis;

two second connecting means, each being connected to an end of a respective one of the two tines of the Y-shaped top supporting member for forming a second rotating axis;

a second rotation supporting means having both ends, each end being connected to a respective one of the second connecting means for rotating the tracking antenna around the second rotating axis;

a third connecting means for forming a third rotating axis at a center of the second rotation supporting means; and a supporting means connected to the third connecting means in a predetermined shape for supporting the tracking antenna, wherein the first, second and third rotating axes are not crossed one another, wherein the center of gravity of a first combination of the first rotation supporting means, the two second connecting means, the second rotation supporting means, the third connecting means, the supporting means and the tracking antenna is present on the first rotating axis, wherein the center of gravity of a second combination of the second rotation supporting means, the third connecting means, the supporting means and the tracking antenna is present on the second rotating axis, and wherein the center of gravity of a third combination of the supporting means and the tracking antenna is present on the third rotating axis.

* * * * *